US011840922B2

(12) United States Patent
Arab et al.

(10) Patent No.: US 11,840,922 B2
(45) Date of Patent: Dec. 12, 2023

(54) BLOW-OUT PREVENTER TEST SPOOL SYSTEM

(71) Applicant: Abu Dhabi National Oil Company, Abu Dhabi (AE)

(72) Inventors: Mohammed Abu Arab, Abu Dhabi (AE); Omar Auf Abdul Rahman, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 243 days.

(21) Appl. No.: 17/298,193

(22) PCT Filed: Nov. 28, 2018

(86) PCT No.: PCT/IB2018/059389
§ 371 (c)(1),
(2) Date: May 28, 2021

(87) PCT Pub. No.: WO2020/109840
PCT Pub. Date: Jun. 4, 2020

(65) Prior Publication Data
US 2022/0098977 A1 Mar. 31, 2022

(51) Int. Cl.
*E21B 33/06* (2006.01)
*E21B 47/117* (2012.01)

(52) U.S. Cl.
CPC ..... *E21B 47/117* (2020.05); *E21B 33/06* (2013.01)

(58) Field of Classification Search
CPC ..... E21B 47/117; E21B 33/06
See application file for complete search history.

(56) References Cited

U.S. PATENT DOCUMENTS 4,018,276 A 4/1977 Bode
4,090,395 A 5/1978 Dixon et al.
(Continued)

FOREIGN PATENT DOCUMENTS

CN 201083101 Y * 7/2008
CN 201083101 Y 7/2008
(Continued)

OTHER PUBLICATIONS

International Search Report and Written Opinion of the International Searching Authority for corresponding International Patent Application No. PCT/IB2018/059389, dated Feb. 1, 2019.
(Continued)

*Primary Examiner* — Taras P Bemko
(74) *Attorney, Agent, or Firm* — Renner, Otto, Boisselle & Sklar, LLP

(57) ABSTRACT

The present invention relates to a blow-out preventer BOP test spool system, comprising a test spool to be mounted between a well head and a blow-out preventer; the test spool having an inner cylindrical hole extending in vertical direction of the test spool; the inner cylindrical hole in vertical direction comprising an upper section and a lower section, wherein the lower section comprises a smaller inner diameter than the inner diameter of the upper section; and a test plug, insertable into the inner cylindrical hole of the test spool, the test plug having a cylindrical outer shape with an outer diameter that is smaller than the inner diameter of the upper section and is larger than the inner diameter of the lower section, such that the plug can abut a loading shoulder between the upper and lower section and the plug is not able to move further down within the test spool. The invention also relates to a corresponding method for testing a blow-out preventer.

11 Claims, 5 Drawing Sheets

(56) References Cited

U.S. PATENT DOCUMENTS

Figure 1:
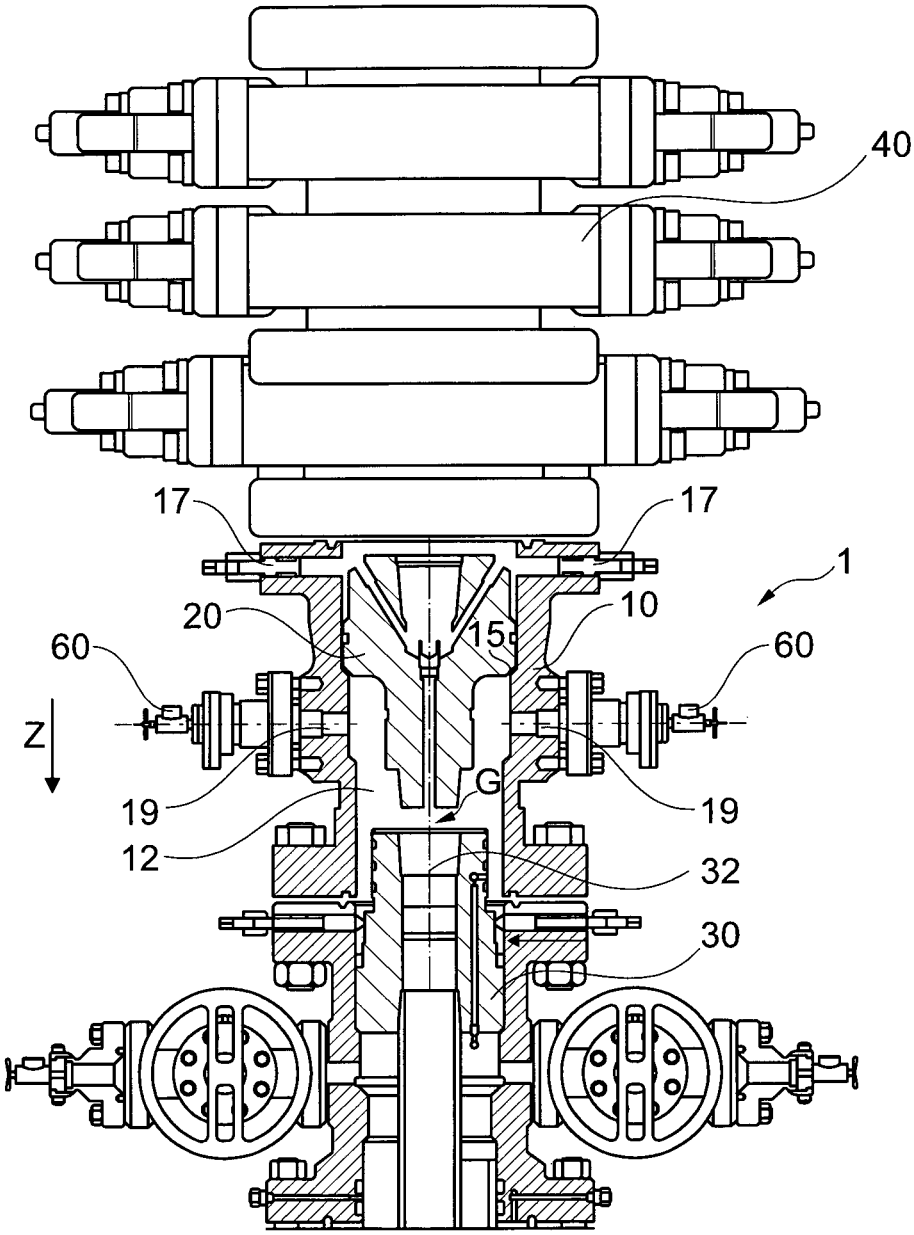

| | | | | |
|---|---|---|---|---|
| 4,559,809 | A * | 12/1985 | Mayo | E21B 47/117 73/49.1 |
| 6,152,225 | A * | 11/2000 | Young | E21B 33/06 166/337 |
| 8,899,315 | B2 * | 12/2014 | Nguyen | E21B 33/03 166/85.1 |
| 9,470,082 | B1 | 10/2016 | Williams et al. | |
| 9,841,343 | B1 | 12/2017 | Hellail et al. | |
| 2005/0199389 | A1 | 9/2005 | Dallas et al. | |
| 2005/0269079 | A1 | 12/2005 | Franklin et al. | |
| 2008/0251251 | A1 | 10/2008 | Dallas et al. | |
| 2012/0012341 | A1 | 1/2012 | White et al. | |
| 2017/0101840 | A1 * | 4/2017 | Kauffmann | E21B 23/01 |
| 2017/0241230 | A1 * | 8/2017 | Cruickshanks | E21B 34/045 |
| 2021/0277738 | A1 * | 9/2021 | Mukhlifi | E21B 33/06 |

FOREIGN PATENT DOCUMENTS

| | | | |
|---|---|---|---|
| CN | 201218070 | Y | 4/2009 |
| CN | 201363117 | Y | 12/2009 |
| CN | 201428415 | | 3/2010 |
| CN | 202176297 | U | 3/2012 |
| CN | 203808915 | | 9/2014 |
| CN | 204060608 | U | 12/2014 |
| CN | 104989314 | A | 10/2015 |
| EP | 1350919 | | 10/2003 |

OTHER PUBLICATIONS

Original and English-language Translation of The First Chinese Office Action, issued for corresponding Chinese Application No. 201880100597.3, dated Nov. 2, 2022.

* cited by examiner

BLOW-OUT PREVENTER TEST SPOOL SYSTEM

This application is a national phase of International Application No. PCT/IB2018/059389, filed on Nov. 28, 2018, the entirety of which is hereby incorporated herein by reference.

1. TECHNICAL FIELD

The present invention relates to a blow-out preventer BOP test spool system and a method for testing a blow-out preventer for wells that have obsolete or damaged equipment that prevent the regular BOP testing procedures.

2. BACKGROUND OF THE INVENTION

The present invention relates, in particular, to integrity testing of blow-out preventer (BOP) stacks. BOPs can be categorized as annular or ram BOPs and BOP stacks frequently utilize both types, typically with at least one annular BOP stacked above several ram BOPs. BOP stacks are used on land, offshore and sub-sea rigs as a sealing cover over a wellhead during drilling operations. Land and sub-sea BOPs are secured on the top of the wellhead. BOPs on offshore rigs are mounted below the rig deck. Sub-sea BOPs are connected to an offshore rig by a drilling riser that provides a continuous pathway for the drill string and fluids emanating from the well bore. In effect, a riser extends the well bore to the rig.

A BOP effectively seals the wellhead and regulates suddenly arising erratic pressures and uncontrolled flows emanating from the formation below which are also referred to as formation uncontrolled kicks. The BOP is then used to seal the flow channel of a well and/or to shear the drill string and completely shut the well down, if need arises.

In a well workover operation, the well must be secured at first. This process involves removing the so called "Christmas tree" and replacing it by a BOP stack. The wellhead then becomes a closed system with BOP stack and the BOP stack should be tested to verify its integrity. However, in some cases the BOP stack cannot be tested due to one or more of the below reasons:

1. Damage of the tubing hanger body seal, which leaks the pressure from BOP area into annual cavity during the BOP test before the test is completed.
2. Damage in the tubing hanger top threads, which leaks the pressure from BOP area into production string/wellbore during the BOP test before the test is completed.
3. Localized corrosion of the tubing head spool sealing bowel, which leaks the pressure from BOP area into annual cavity during the BOP test using a wellhead test plug. This is regarding the BOP test after the test is completed and during workover drilling operation.
4. Obsoleted wellhead for which service tools are not available anymore, nor they can be manufactured as usually such manufacturer is no longer in the market. This is regarding the BOP test after the test is completed and during workover drilling operation.

Furthermore, during a work over of wells and/or a re-entry of old wells, and after removing the Xmas tree and installing the BOP stack, the integrity of the BOP needs to be verified prior well intervention and removing the completion, thus, due to issues #1 and #2 above the pressure leak is continuous and BOP stack cannot hold test pressure. In this case, the drill operation will continue with safety compensation and a so called "drilling under risk" procedure. Furthermore, a dispensation will be required to continue the rig operations while reduced HSE measures through drilling without full integrity check for the BOP (depending on BOP test reports of previous well or offline testing).

Besides, a scheduled complete BOP test is a mandatory requirement to verify the drill operations safety and assure well control equipment in order to proceed with risk-free operations. However, it might be that an old wellhead suffers from issues related to #3 or #4 above and, thus, it will be impossible to completely test the BOP stack. In this case, the drill operation will continue with safety compensation and a so called "drilling under risk". Furthermore, a dispensation will be required to continue the rig operations while reduced HSE measures are carried out by conducting the HSE scheduled BOP testing partially instead of a full test due to the bowel damage (partial test is conducted against of pipe rams closed only). The partial test, however, cannot fully exclude the risk of a BOP failure during drilling and will eventually lead to well control problems The document US 2012/0012341 describes a spool used for forming a dual sealing barrier for a well during suspension of drilling. The spool is adapted to be connected to a wellhead and includes a dummy hanger, which is inserted into the spool. The dummy hanger includes an annular sleeve and a removable axial plug, disposed within the sleeve. The spool comprises a straight central bore and, thus requires a plurality of locking pins to secure the dummy hanger in place.

The document U.S. Pat. No. 9,470,082 describes a solid test pin, used for sealing a test plug in a wellhead. The corresponding method discusses the secure placing, separating, reattaching and removing of the solid test pin. Moreover, a method for testing all fixed and variable rams and annulars of the BOP and testing all blind and shear rams, without damage to the pipe is described.

The document CN203808915 describes a plugging device for an oil pipe hanger. Thereby, the document shows a main body (spool) which includes a ball valve mechanism within the main body. The valve mechanism includes a seat, and ball valve, with an accompanying spring seat and includes a ball shoulder. The mechanism is designed to effectively seal the hanger or through hole.

The document CN201428415 describes a quick pressure testing device of a well blow-out preventer. The preventer includes a blowout preventer main body, a totally enclosed shutter assembly and a semi-closed shutter assembly. Further, the preventer includes an internal plug, arranged under the semi-enclosed shutter of the preventer main body.

The document EP1 350 919 describes an adaptor having a body and two opposing ends. The bottom end is designed for a connection to a standard "Christmas tree" re-entry hub and a top end having a top profile suitable for interfacing for nominal bore configuration drilling or completion equipment.

So far, a drilling after a mere partial test of the BOP was conducted by a dispensation of the Management of Change and a so called "drill under risk". However, the completion of the dispensation and securing the safety equipment on the rig site may cost about 48 hours of valuable rig time in addition to material and rental of safety equipment which have to be held in standby during the drill operation.

It is a problem of the present invention to provide a device that overcomes the above mentioned requirements and constraints.

3. SUMMARY OF THE INVENTION

At least one of the problems is solved by a blow-out preventer test spool system according to claim 1 and a method for testing a blow-out preventer according to claim 12.

Particularly, the problem is solved by a blow-out preventer BOP test spool system, comprising a test spool to be mounted between a wellhead and a blow-out preventer, the test spool having an inner cylindrical hole extending in vertical direction of the test spool, the inner cylindrical hole in vertical direction comprising an upper section and a lower section, wherein the lower section comprises a smaller inner diameter than the inner diameter of the upper section, and a test plug, insertable into the inner cylindrical hole of the test spool, the test plug having a cylindrical outer shape with an outer diameter that is smaller than the inner diameter of the upper section and is larger than the inner diameter of the lower section, such that the plug can abut a loading shoulder between the upper and lower section and the plug is not able to move further down within the test spool.

The blow-out preventer BOP test spool system enables a complete testing of the blow-out preventer, without requiring a reliable connection to the wellhead prior well intervention or during drilling operations. Thereby, the blow-out preventer test spool system provides a seal between a wellhead and a BOP stack and enables complete well independent pressure tests on the BOPs. In particular, complete pressure tests of the BOPs can be performed before a pulling out of the hole (POOH) operation is conducted, in contrast to common standard, where the complete test for the BOPs is performed after a POOH completion. As a result, the protection of people and equipment during workover on old wells is significantly increased. Furthermore, the drilling under risk of having a well kick-off during removal of old wells equipment without proper securing the well is avoided which leads to a better well control.

The insertion and removal of test plug in-connection with the drill-pipe serves for a reliable seal for the BOP pressure testing operations. The loading shoulder allows abutting the test plug in vertical direction such that no further locking of the test plug for the pressure testing is required. This saves operation time and effort, particularly it saves any effort for locking a test plug with lock-down screws, which is however, optional.

Preferably, the loading shoulder comprises a ring-shaped surface tapered in vertical downward direction. Due to the tapered shape of the inner hole of the blow-out preventer test spool a test plug can be easily inserted and is automatically centered at a certain location inside the test spool. No further mounting tools, like e.g. additional screws, are required to keep the test plug in place. This facilitates the test procedure. Moreover, because the test pressure is applied to the BOPs above the test plug, the test plug is solely pressed downwards during a test and centrically abuts the tapered loading shoulder.

Preferably, the blow-out preventer test spool system comprises lock down screws that are radially arranged in the upper section of the blow-out preventer test spool and are able to engage into the inner cylindrical hole (test plug bowel) from the outside and to abut the test plug in order to prevent vertical movement of the test plug. The lock down screws secure the test plug in place also when pressure eruptions from the well are given. Thus, the test plug does not move even if a pressure eruption takes place from below in the well. Therefore, the blow-out preventer test spool can also be used to seal the well in particular in case of a BOP failure. This is an additional security measure for the well.

Preferably, the blow-out preventer test spool system comprises radially arranged side outlets in the lower section of the test spool. These side outlets can be used for introducing mud, i.e. drilling fluid, into the well during drilling operations (circulation process). Thereby, the blow-out preventer test spool may excise the need for a separate mud spool, thus, keeping the overall length of the BOP stack small which is an advantage in particular in space restrictive rig environments. In addition, in case of well outbreak and if the well is secured via BOP test plug, the BOP test spool side outlets can be used to kill the well by injecting killing fluid since it opens below the sealing profile of the test plug and is secured with fully rated gate valves.

Preferably, the test plug comprises an upper part and a lower part, wherein the lower part has a smaller outer diameter than the upper part and extends downwards into the lower section of the blow-out preventer test spool. This feature of having double cylindrical diameters will facilitate the operations of rigs that have misalignment with well bore, as it serves as a guiding neck.

Preferably, the blow-out preventer test spool system is designed such that, with the test plug inserted in the test spool, a communication between side outlets and wellbore below the test plug is available, wherein the side outlets are selectively closed by control barriers. The control barriers can preferably be high pressure gate valves, This is used to control the well in case of formation kick appearing during the testing of the BOP.

Preferably, the test plug comprises a central threaded hole extending throughout the center line of the test plug. This hole is preferably fitted with blind plug profile (sealing threads) which can be used to equalize the buildup pressure below the test plug during retrieving process after finishing the test. This feature is optional depending on the well type, characteristics and thermal fluids expansion factor. In case this feature is not used, a blind plug can be kept installed instead.

Preferably, the central threaded hole of the test plug can be closed by a blind plug.

Preferably, the test plug comprises inner threads in the central threaded hole at its upper end and outer or inner threads at its lower end. The test plug can be easily connected to a drill-pipe from top and can be suspended the in-hole drilling string from below, in case BOP scheduled test is performed while drilling operation with bits in-hole. Thereby, threads provide an easy and reliable connection depending on the drill pipe standard used on rig site. Preferably IF type threads can be used.

Preferably, the test plug comprises radial sideway channels going downwards inclined from the outer circumference at the upper end towards the inner circular hole. Those holes play an important rule for facilitating make-up and release of drill-pipe with test plug as they act as pressure equalization holes to assure perfect threads make-up.

Preferably, the blow-out preventer test spool is further comprising a wear bushing insertable into the upper section of the blow-out preventer test spool, wherein the wear bushing can fit in place instead of the test plug, for protecting the test spool sealing area during a drilling operation. The wear bushing is installed after withdrawal of the old completion equipment and prior starting of the drilling process. The wear bushing protects the sealing area of the BOP test spool during the drilling process.

Preferably, the BOP Test Spool is designed with a fully opened bore with special shoulder allowing the total access to the equipment below it. With this feature an old tubing hanger and all downhole accessories can be removed through the BOP test spool without obstruction while maintaining the complete integrity of the well. The special shoulder is designed to hold/stop the Test plug and wear busing at sealing area.

The above mentioned problem is further solved by a method of testing a blow-out preventer, the method comprising the steps of providing a blow-out preventer test spool system in-between a wellhead and a blow-out preventer, wherein the blow-out preventer test spool system comprises a test spool and a test plug, inserting the test plug into the blow-out preventer test spool and arranging the test plug on a loading shoulder inside the blow-out preventer test spool, and testing the blow-out preventer by applying pressure to the blow-out preventer above the blow-out preventer test spool.

Preferably, a drill pipe is used for arranging the test plug on a loading shoulder inside the blow-out preventer test spool. Thereby, the drill pipe moves the test plug until it reaches the loading shoulder such that test plug sealing elements seal on an inner sealing area of the test spool.

The present method of testing a blow-out preventer enables a complete test the BOP before a POOH of old completion operation is performed regardless of the following potential negative well conditions:

- damage in the tubing hanger top threads
- damage of the tubing hanger body seal
- localized corrosion of the tubing head spool sealing bowel, or
- an obsoleted wellhead for which service tools are not available anymore, nor can they be manufactured because the manufacturer does not participate at the market anymore.

Thereby, the test plug can be easily inserted and is automatically guided in place by abutting to the loading shoulder. Thus, a test of the BOP is facilitated and can be performed easily, in particular under difficult environmental conditions like the deep-sea.

Preferably, the method further comprises the step of locking the test plug in the blow-out preventer test spool by engaging and abutting lock down screws to the test plug in order to secure it in the right place. The blow-out preventer test spool includes a plurality of lock down screws used to set the test plug within the blow-out preventer test spool in order to prevent it from moving in case any pressure blows from below the plug (reservoir) and isolate the BOP from any well pressure. Thereby, the screws can easily and releasable engage and abut the test plug to hold it in place. As a result, maintenance and testing of the BOP stack may be performed easily before commencing additional drilling operations.

Preferably, the method further comprises the step of using the blow-out preventer test spool in deep-water applications. Exploitable reservoirs of oil and gas are increasingly rare and remote, leading to increased sub-sea deep-water well exploration. Thereby, the BOPs remain submerged for as long as a year in extreme conditions. As a result, BOP assemblies have grown larger and heavier (e.g. a single ram-type BOP unit can weigh in excess of 30,000 pounds), while the space allotted for BOP stacks on existing offshore rigs has not grown commensurately. The present invention provides the advantages of limiting the footprint and weight with a compact blow-out preventer test spool while simultaneously increasing safe operating capacity as it can replace the BOP spacer spools or drilling spools.

The above mentioned problem is also solved by a use of a blow-out preventer test spool for testing the blow-out preventer and/or for sealing a wellhead in place of the blow-out preventer in case the well came alive and the BOP need to be replaced. This is possible since the combination of BOP test spool with test plug installed represents a mechanical barrier to seal the live well.

4. SHORT DESCRIPTION OF THE DRAWINGS

Figure 2:
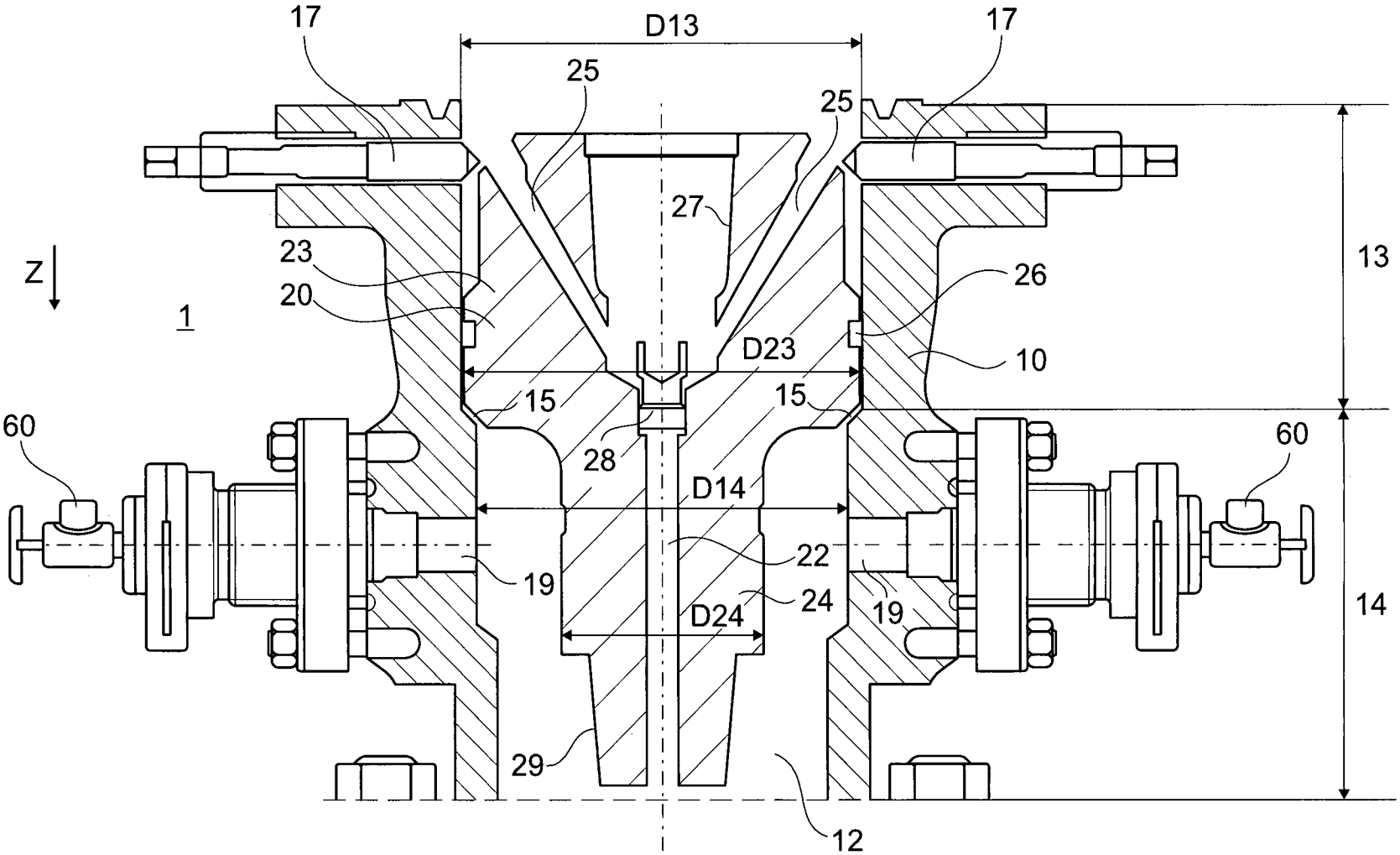
Figure 3B:
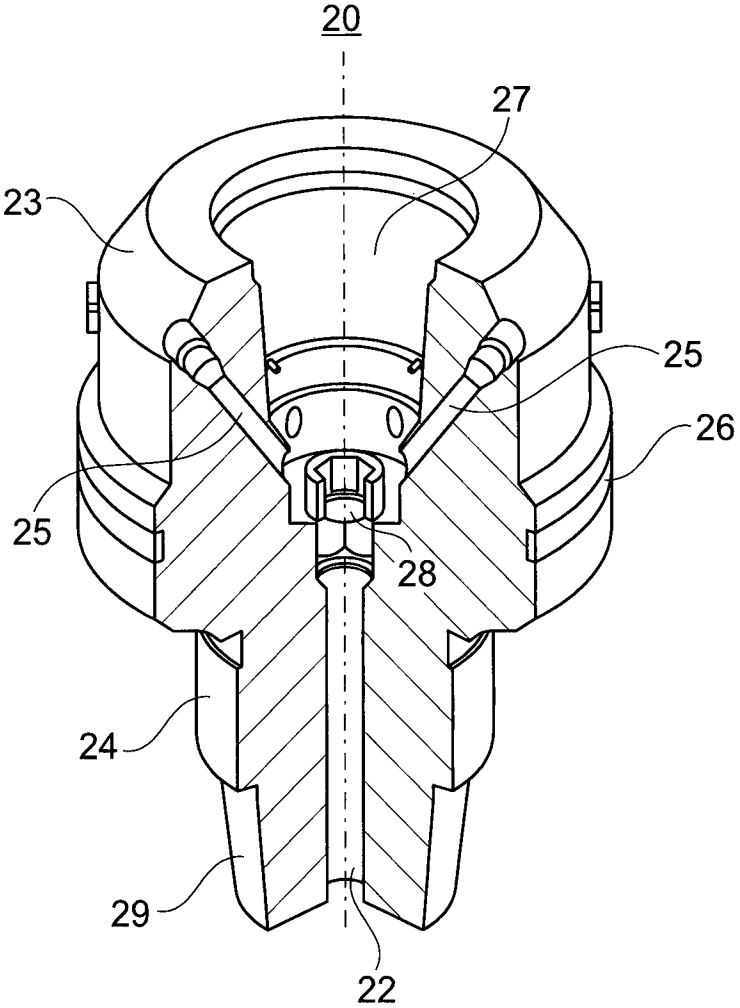
Figure 3A:
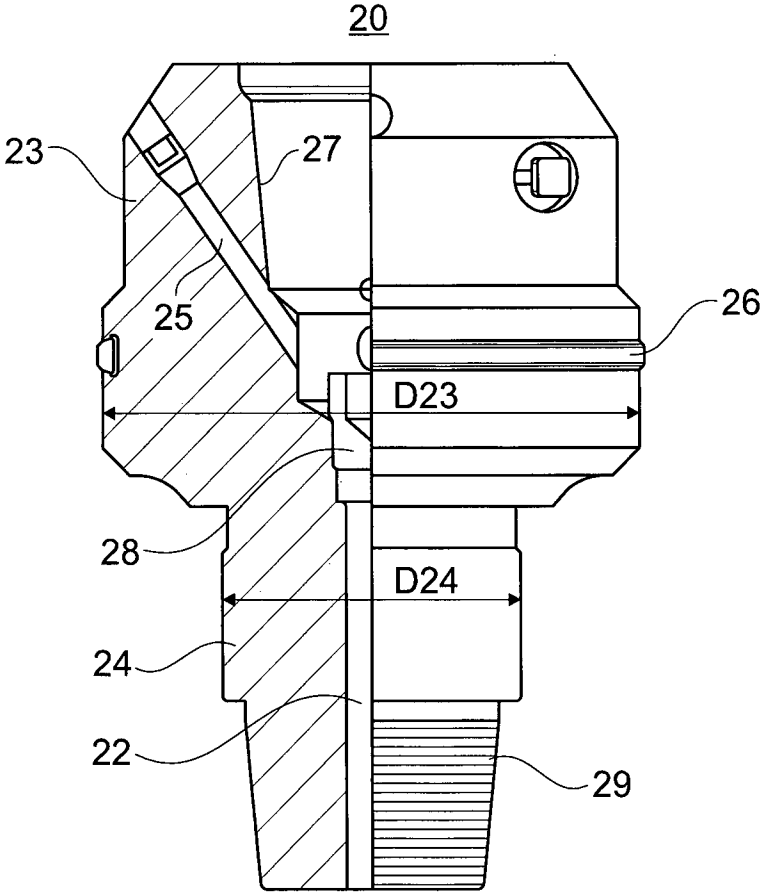
Figure 4:
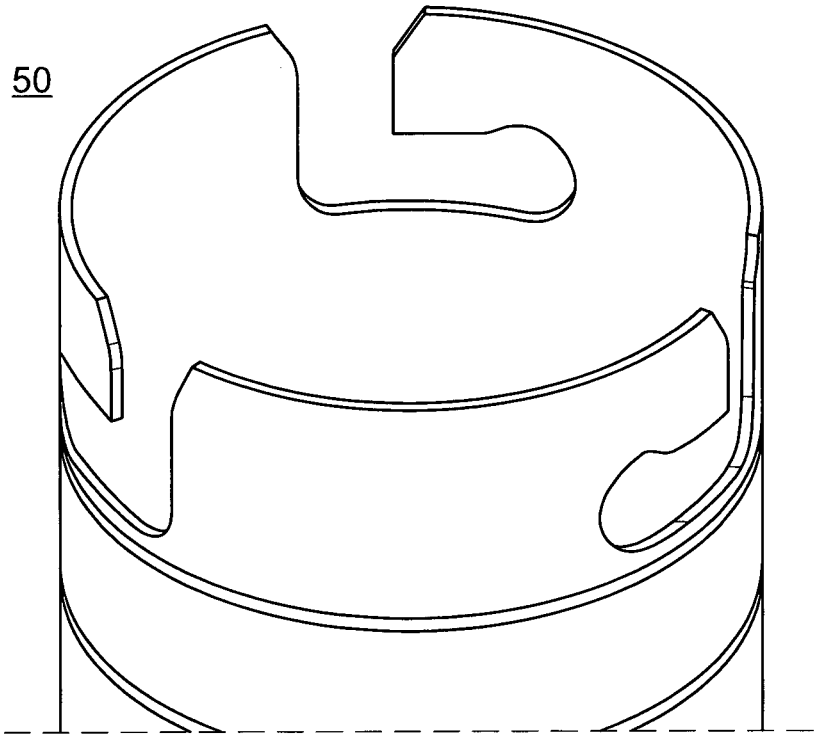
Figure 5:
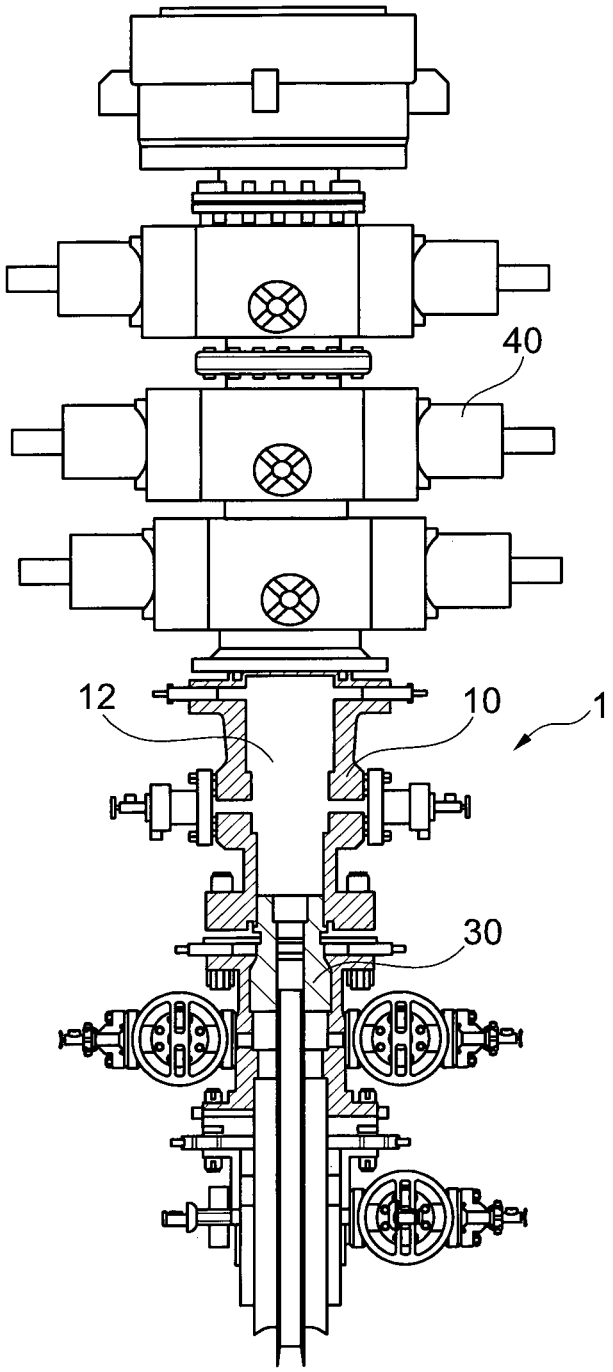

In the following, preferred embodiments of the invention are disclosed by reference to the accompanying figures, in which shows:

FIG. 1 a partial sectional side view of an embodiment of the blow-out preventer test spool system mounted between a wellhead at the bottom and a blow-out preventer at the top;

FIG. 2 a partial sectional side view of an embodiment of the blow-out-preventer test spool system;

FIG. 3A a partially sectional side view of an embodiment of a test plug;

FIG. 3B a three-dimensional partial sectional view of the test plug of FIG. 3A FIG. 4 a three dimensional view of an embodiment of a wear bushing; and FIG. 5 a partial sectional side view of an embodiment of the blow-out preventer test spool system mounted between the wellhead and the blow-out preventer without a test plug inserted.

5. DETAILED DESCRIPTION OF PREFERRED EMBODIMENTS

In the following, preferred embodiments of the invention are described in detail with respect to the figures.

During normal operations a full wellhead (not shown) is installed over the well in which the full wellhead controls the reservoir pressure. However, during a workover procedure, the operation starts with securing the well, before pulling the completion and accessing the well bore for the planned operation. Thereby, the so called "Xmas tree" is removed and replaced by a blow-out preventer BOP 40, as can be seen in FIG. 5. Then, a test plug 20 is inserted into the test spool 10, as it is shown in FIG. 1. After that, the wellhead 30 is closed by means of the blow-out preventer test spool system 1 and a complete set of tests is performed on the BOP 40 including the following:

Blind Ram Hydro/Gas test
Pipe Ram Hydro/Gas test
Shear Ram Hydro/Gas test

After a successful testing of the BOP 40 the drilling/workover operations may start.

FIG. 1 shows a blow-out preventer test spool system 1 assembled in-between a wellhead 30 at the bottom and a blow-out preventer (BOP) 40 at the top. The blow-out preventer test spool system 1 is mounted to the wellhead 30 and the BOP 40 by means of flanges. Thereby, different sizes of flanges can be applied in order to connect the blow-out preventer test spool to a variety of BOPs 40 and wellheads 30. The flanges can be connected by screwing, welding or any other durable connection.

The inner diameter of the test spool 10 of the blow-out preventer test spool 1 corresponds to the inner diameter of the wellhead 30. Thus, as can be seen best in FIG. 5 where the test plug is removed, the complete equipment can be routed through the blow-out preventer test spool 1 without any restrictions.

During tests of the BOP 40 the test plug 20 is inserted into the test spool 10 of the blow-out preventer test spool system 1. The test plug 20 can be inserted by drill pipe (not shown) threaded to the test plug 20 at the test plugs 20 upper inner threads 27. The drill pipe then guides the test plug 20 down to the blow-out preventer test spool 10. The test plug 20 has reached its final place inside the test spool 10 of the blow-out preventer test spool system 1 when it abuts loading shoulder 15. Then the drill pipe can be removed from the test plug 20 and the test plug 20 is held in place by gravity and the loading shoulder 15.

As can be seen in FIG. 2, a circumferential sealing 26 at the test plug 20 seals the test plug 20 inside the test spool 10 and seals the inner hole 12. Additionally, lock down screws 17 arranged at the upper side of the blow-out preventer test spool 1 can be inserted from the outside to the inner hole 12 of the test spool 10. These lock down screws 17 are radially arranged around the circumference of the test spool 10. In the fully inserted state, the lock down screws 17 abut and partially rest above the inserted test plug 20 such that the lock down screws 17 hold the test plug 20 in place. Thereby, the test plug 20 cannot move upwards, in (negative) vertical direction Z, even if pressure from below, i.e. well pressure, is given. As a consequence, the secured test plug 20 may also serve as a sealing for the wellhead 30, in particular in case of any BOP 40 failure.

The test spool 10 and the test plug 20 have a design such that a fluid communication between side outlets 19 and wellbore below the test plug 20 is available. Thereby, preferably a gap G is provided between the lower end of the test plug 20 and the upper end 32 of the wellhead 30. The side outlets 19 can be closed by control barriers 60, such as high-pressure gate valves.

The blow-out preventer test spool system 1 can be used to perform the below functions:

- to fully test the BOP 40 while it is on well during workover wells and before starting drilling operations,
- give the ability to perform the scheduled BOP 40 testing even during the drilling process as the test plug 20 is designed to fit between drill pipes to land into the test spool 10 profile and secured by the lock down screws 17 since the scheduled tests of BOP 40 is mandatory to be done each 14 days as per the drilling policies and standards around the world, and
- during drilling operations, if any problem occurred for the BOP 40 that required dismantling and replacement of spares, the test plug 20 can be set into the test spool 10 and can be secured by the lock down screws 17 on the test spool 10 itself and isolate the BOP 40 from the well pressure at which a maintenance and re-test of the BOP 40 can be performed before commencing the drilling operation.

The test plug 20, as it is shown in FIGS. 3A and 3B, is a solid rotational symmetric member preferably made of metal or any other durable material. In particular, the test plug 20 is pressure resistant in order to endure the test pressure applied to the BOP 40 or any upcoming pressure from the wellhead 30 (from the well side).

The test plug 20 can be logically divided into an upper part 23 and a lower part 24, wherein the lower part itself could be further logically divided into a threaded part 29 and an unthreaded part. The threaded part is used to suspend the drill pipe in case of testing the BOP 40 during drilling operations. This threading part can be of pin or box design (inner or outer threads) depending on the drilling nature, standard and material type. A central threaded hole 22 at the center of the test plug 20 allows for a fluid connection between the upper end and the lower end of the test plug 20. This fluid connection can be blocked by stopper blind plug 28 that is releasably insertable into the inner central threaded hole 22. The blind plug 28 comprises sealing threads to isolate pressure when installed. Furthermore, sideway channels 25 provided an additional fluid communication between the central threaded hole 22 and the outer circumference of the test plug 20. These channels 25 are closed with threaded pressure seal plugs and they are opened to facilitate installation of a blind drill pipe or collars in order to avoid a pressure trap which would cause a false make-up torque. Besides that, the channels 25 can be used to wash out the test spool 10 sealing area from depress and mud after operations. This is done by opening all the side holes 25 after make-up of drill pipe, then placing the test plug 20 into the test spool 10 and injected water through the drill pipe.

Furthermore, the blow-out preventer test spool 1 comprises of two radially arranged side outlets in the lower section 14 of the blow-out preventer test spool 1. Those side outlets can be used for the following:

1. Drilling fluid circulation during the drilling process.
2. Kill the well, wherein the well is sealed with the test plug 20.
3. Kill the well if the BOP 40 is activated and sealed-on or if the drill pipe (not shown) is sheared-off.

FIG. 5 shows an embodiment of a wear bushing 50 that is inserted into the test spool 10 in place of the test plug 20 during drilling operation. Thereby, the wear bushing 50 protects the inner sealing area of the test spool 10 where the test plug 20 seals on.

LIST OF REFERENCE SIGNS

1 blow-out preventer test spool system
10 test spool
12 inner cylindrical hole
13 upper section
14 lower section
15 loading shoulder
17 lock down screws
19 side outlets
20 test plug
22 central threaded hole
23 upper part
24 lower part
25 sideway channels
26 sealing
27 inner threads
28 blind plug
29 outer threads
30 wellhead
32 upper end
40 blow-out preventer
50 wear bushing
60 control barriers
D13 inner diameter (upper section)
D14 inner diameter (lower section)
D23 outer diameter (upper part)
D24 outer diameter (lower part)
G gap
Z vertical direction

The invention claimed is:

1. A blow-out preventer BOP test spool system, comprising:

a test spool to be mounted between a wellhead and a blow-out preventer;

the test spool having an inner cylindrical hole extending in vertical direction of the test spool;

the inner cylindrical hole in vertical direction comprising an upper section and a lower section, wherein the lower section comprises a smaller inner diameter than the inner diameter of the upper section; and a test plug, insertable into the inner cylindrical hole of the test spool, the test plug having a cylindrical outer shape with an outer diameter that is smaller than the inner diameter of the upper section and is larger than the inner diameter of the lower section, such that the plug can abut a loading shoulder between the upper and lower section and the plug is not able to move further down within the test spool;

wherein the test plug comprises an upper part and a lower part, wherein the lower part has a smaller outer diameter than the upper part and extends downwards into the lower section of the blow-out preventer test spool; and wherein the test plug comprises inner threads in a central threaded hole at its upper end and outer threads at its lower end.

2. The blow-out preventer test spool system according to claim 1, wherein the loading shoulder comprises a ring-shaped surface tapered in vertical downward direction.

3. The blow-out preventer test spool system according to claim 1, wherein the test spool comprises lock down screws that are radially arranged in the upper section of the test spool and are able to engage into the inner cylindrical hole from the outside and to abut the test plug in order to prevent vertical movement of the test plug.

4. The blow-out preventer test spool system according to claim 1, further comprising radially arranged side outlets in the lower section of the test spool.

5. The blow-out preventer test spool system according to claim 1, wherein the blow-out preventer test spool system is designed such that, with the test plug inserted in the test spool, a communication between side outlets and wellbore below the test plug is available, wherein the side outlets are selectively closed by control barriers.

6. The blow-out preventer test spool system according to claim 1, wherein the test plug comprises a central threaded hole extending throughout the center line of the test plug.

7. The blow-out preventer test spool system according to claim 6, wherein the central threaded hole of the test plug can be closed by a blind plug.

8. The blow-out preventer test spool system according to claim 6, wherein the test plug comprises radial sideway channels going downwards inclined from the outer circumference at the upper end towards the central threaded hole.

9. The blow-out preventer test spool system according to claim 1, further comprising a wear bushing insertable into the upper end of the test spool, wherein the wear bushing can fit in place instead of the test plug, for protecting a sealing area of the test spool during a drilling operation.

10. A method of testing a blow-out preventer, the method comprising the steps:

providing the blow-out preventer test spool system according to claim 1, in-between a wellhead and a blow-out preventer, wherein the blow-out preventer test spool system comprises a test spool and a test plug;

inserting the test plug into the blow-out preventer test spool and arranging the test plug on a loading shoulder inside the test spool; and testing the blow-out preventer by applying pressure to the blow-out preventer above the test spool.

11. The method according to claim 10, further comprising the step of locking the test plug in the test spool by engaging and abutting lock down screws to the test plug in order to secure the test plug in place.

* * * * *